US006089398A

United States Patent [19]

Weinstein

[11] Patent Number: 6,089,398

[45] Date of Patent: Jul. 18, 2000

[54] EXPLOSION RESISTANT ASSEMBLY INCLUDING MUTUALLY ENGAGEABLE FLANGES

[75] Inventor: Edward M. Weinstein, Margate, N.J.

[73] Assignee: Galaxy Scientific Corporation, Pleasantville, N.J.

[21] Appl. No.: 09/121,916

[22] Filed: Jul. 24, 1998

Related U.S. Application Data

[60] Provisional application No. 60/075,340, Feb. 20, 1998, and provisional application No. 60/056,389, Aug. 26, 1997.

[51] Int. Cl.[7] ..... B65D 45/20

[52] U.S. Cl. ..... 220/324; 220/811; 220/817

[58] Field of Search ..... 220/1.5, 324, 315, 220/325, 811, 817, 819, 833, 837, 836

[56] References Cited

U.S. PATENT DOCUMENTS

| | | | |
|---|---|---|---|
| 1,183,692 | 5/1916 | Strout . | |
| 1,278,968 | 9/1918 | Maki . | |
| 2,939,365 | 6/1960 | Vaiden | 89/1 |
| 3,268,158 | 8/1966 | Abbott | 232/1 |
| 3,655,087 | 4/1972 | Luisada | 220/1.5 |
| 3,811,747 | 5/1974 | Levin | 312/308 |
| 4,106,663 | 8/1978 | Nakao . | |
| 4,175,672 | 11/1979 | Moser . | |
| 4,221,302 | 9/1980 | Kupersmit | 220/4.31 |
| 4,262,447 | 4/1981 | Schneier et al. . | |
| 4,411,372 | 10/1983 | Basterfield et al. . | |
| 4,432,285 | 2/1984 | Boyars et al. | 109/49.5 |
| 4,475,571 | 10/1984 | Houston, Jr. et al. . | |
| 4,580,688 | 4/1986 | Harris et al. . | |
| 4,763,732 | 8/1988 | Neal . | |
| 4,923,076 | 5/1990 | Weiss et al. | 110/1.5 |
| 4,932,160 | 6/1990 | Sperko | 49/254 |
| 5,201,434 | 4/1993 | De Vivo et al. . | |
| 5,248,055 | 9/1993 | Sanai et al. . | |
| 5,310,049 | 5/1994 | Bigelow et al. . | |
| 5,358,135 | 10/1994 | Robbins et al. . | |
| 5,411,163 | 5/1995 | Gueret . | |
| 5,421,626 | 6/1995 | Glachet . | |
| 5,890,612 | 4/1999 | Coppi | 220/7 |

FOREIGN PATENT DOCUMENTS

| | | |
|---|---|---|
| 663350 A1 | 7/1995 | European Pat. Off. . |
| 2705396 A1 | 11/1994 | France . |
| 27 02 031 | 7/1978 | Germany . |
| 349529 | 11/1929 | United Kingdom . |

*Primary Examiner*—Stephen Castellano
*Attorney, Agent, or Firm*—Pillsbury Madison & Sutro Intellectual Property Group, LLP

[57] ABSTRACT

This lightweight explosion-mitigating assembly includes at least a containment structure and a door. The containment structure and door each include at least one set of engagement flanges. The flanges are movable between an interlocking arrangement and a non-interlocking arrangement. In the non-interlocking arrangement, the flanges are sufficiently relatively operatively free from each other to permit movement of the door relative to the containment structure between open and closed positions. On the other hand, in the interlocking arrangement, the door is in the closed position and the flanges are both mutually engageable and slidable relative to each other into mutual engagement and out of mutual engagement. When mutually engaged, the containment-structure flange and the door flange are not pivotal relative to each other between the interlocking and non-interlocking arrangements, yet sliding movement of the flanges relative to each other out of mutual engagement permits at least one of the containment-structure flange and the door flange to be moved relative to each other between the interlocking and non-interlocking arrangements. This structure may be lightweight, especially when elongated flanges are used, and does not rely on the bending stiffness of the structure to mitigate explosive forces.

23 Claims, 11 Drawing Sheets

EXPLOSION RESISTANT ASSEMBLY INCLUDING MUTUALLY ENGAGEABLE FLANGES

This application claims priority of provisional applications Ser. No. 60/056,389, filed Aug. 26, 1997 and Ser. No. 60/075,340, filed Feb. 20, 1998, the complete disclosures of which are incorporated herein by reference.

BACKGROUND OF THE INVENTION

1. Field of the Invention

This invention relates to an enclosure assembly designed to receive explosive devices and confine or at least mitigate explosive forces released by their detonation. The enclosure assembly is especially suitable for use with public transportation equipment, such as an in-flight storage receptacle for passenger luggage and other parcels, where suppression of explosive forces from explosive devices hidden in passenger luggage or parcels is essential for the continued safe operation of an aircraft, a boat, train, or other such types of vehicles.

2. Description of Related Art

Over the past decades, there has been (both the perception of and in fact) an increasing threat of terrorism, both domestic and foreign. Perhaps nowhere is this threat more insidious or the public more vulnerable than in air travel, where terrorist tactics, such as the threat of in-flight detonation of an explosive device, undermines the public's confidence in air travel and jeopardizes the lives of the aircraft crew and passengers.

Due to the heavy flow of air traffic and the pressure exerted by airline customers to comply with flight schedules, especially scheduled arrival times and questions of privacy, it is not feasible for airport personnel to search each parcel of luggage individually for hidden explosive devices. Accordingly, to counteract and discourage terrorist threats, there has been a heightened visible presence of airport security equipment and personnel assigned to locate and identify explosive parcels before they are loaded onto an aircraft. Among the equipment and measures exercised for detecting explosive devices in parcels without requiring internal inspection of the parcels are x-ray machines, metal detectors, and in some cased trained canines. Unfortunately, these preventative measures are not infallible, leaving the threat for hidden explosives set for in-flight detonation to be smuggled aboard an aircraft.

Concerns over inadequacies of the above-described anti-terrorist defenses have prompted discussions for the promulgation of regulations intended to supplement such defenses by providing another tier of anti-terrorist protection. Specifically, these discussions concern the provision of reinforced storage containers designed to store passenger luggage and other parcels and, in the case where explosive devices hidden in the luggage are not detected prior to aircraft lift-off, to confine and/or minimize the effect of any in-flight explosive force so as to safeguard the aircraft against catastrophic failure, as occurred in the Pan Am 109 flight. See, for example, Public Law 101–604: Aviation Security Improvement Act of 1990.

While various materials are known for making effectively reinforced explosion resistant containers, one of the most susceptible regions of such containers at the interface of the door and the containment structure. In particular, the release of an explosive force within the container tends to deform the containment structure and door in a radially outward manner. This tends to bend, rotate, and/or twist the sealing devices out of engagement, thereby permitting release of the explosive force, and pulling the door tangentially away from the containment structure. Most traditional blast containment doors relay on the stiffness of both the door and the door frame to resist these actions. These doors are sealed at discrete points, often using heavy duty sliding latches and the like. The stiffness required by these designs leads to heavy implementations. These designs are therefore not appropriate for many uses, such as on vehicles, where there is a weight penalty for such conventional designs. This is especially true in aviation applications.

SUMMARY OF THE INVENTION

It is, therefore, an object of this invention to provide a relatively lightweight luggage container assembly designed to receive and accommodate a number of pieces of passenger luggage as well as other stowed parcels, collectively referred to as luggage, yet which is sufficiently constructed and reinforced at the interface of its housing wall structures and door or entrance structures to maintain engagement of the housing wall structures and door structures during a blast event and thereby substantially confine and/or mitigate the explosive force of an explosive device hidden in the luggage.

In accordance with the principles of this invention, these and other objects are achieved by the provision of an explosion-mitigating enclosure assembly, such as an aircraft-stowable luggage-receiving enclosure assembly, capable of substantially confining the explosive energy of a detonated explosive device disposed in a chamber of the assembly. The assembly comprises a containment structure having at least one access opening designed (for example, by size) to permit movement of articles, e.g., luggage, into and from one or more chambers, and a door structure operatively associated with the access opening to move between an open position in which the interior is accessible through the access opening and a closed position in which the door obstructs and effectively seals the access opening against the movement of luggage and the incursion of rain, etc.

The containment structure and door each include at least one hook-shaped (or J-shaped) engagement flange defining at least one latch-receiving groove. Relative movement between at least one of the containment-structure flange and the door flange permits movement of the engagement flanges between non-interlocking and interlocking relations or arrangements. In the non-interlocking arrangement, the corresponding flanges are sufficiently relatively operatively free of each other to permit movement of the door relative to the containment structure between the open and closed positions. In the interlocking arrangement, the door is closed and the flanges are in a position where they are mutually engaged by being slid relatively towards each other into mutual engagement. When mutually engaged, the containment-structure flange and the door flange are not able to be disengaged by being pivoted out of their engaged position. However, sliding movement of the flanges relative to each other out of their mutual engagement is permitted. After being disengaged by such relative sliding movement, at least one of the containment-structure flange and the door flange can be moved, such as by pivoting, relative to the other so that the door may be opened.

According to one preferred embodiment of this invention, when mutually engaged, the latch-receiving grooves of the corresponding flanges face in substantially opposite directions and a latching portion of the containment-structure flange and a latching portion of the door flange are respectively received in the latching-receiving grooves of the door flange and the containment structure-flange by a sufficient distance and with sufficiently small clearance to prevent disengagement as by, for example, pivoting or rotation of the flanges out of mutual engagement.

The principles of this invention as outlined above are applicable to all types of storage assemblies, but have particular applicability to assemblies intended to confine and suppress the discharge of traumatic explosive forces, such as blast-resistant containers and explosive storage magazines. This invention is especially designed for portable, foldable, or separable wall structures and disposable blast-resistant containers that can be used on, loaded into, and unloaded from aircrafts or other vehicles. Moreover, the principles of this invention may be applicable to various other types of container assemblies, including vessels with reinforced closures intended to tolerate continuous high internal pressures, such as autoclaves.

These and other objects, features, and advantages of this invention will become apparent to those skilled in the art from the following detailed description when taken in conjunction with the accompanying drawings, which illustrate, by way of example, the principles of this invention.

BRIEF DESCRIPTION OF THE DRAWINGS

The accompanying drawings illustrate embodiments of this invention. In such drawings.

DETAILED DESCRIPTION OF THE INVENTION

Figure 1A:
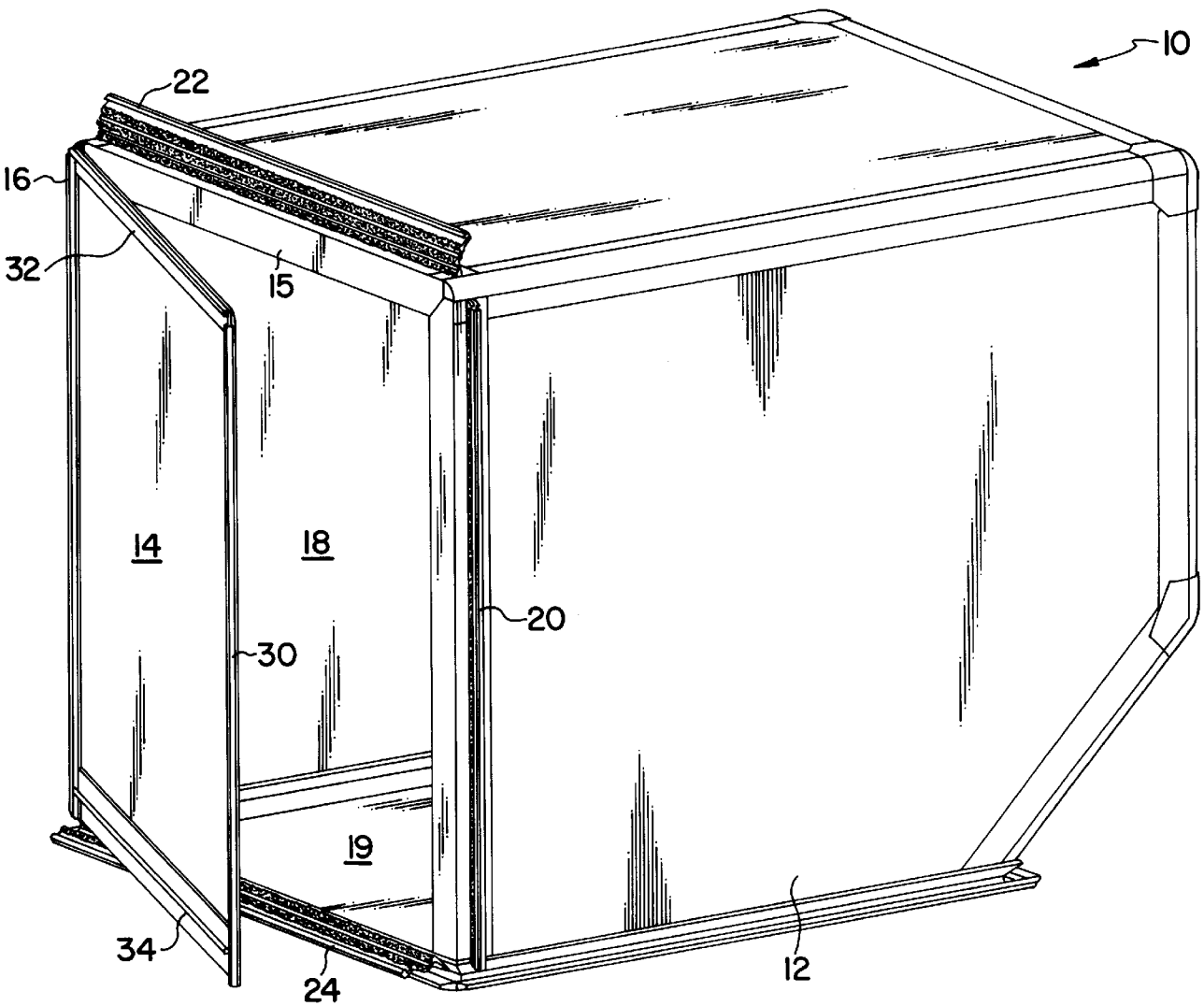
FIG. 1A is a perspective view of an enclosure assembly according to an embodiment of this invention.

Referring now more particularly to the drawings, there is shown in FIG. 1A an assembly 10 which is stowable in a passenger-carrying vehicle, such as a ship or an aircraft, and capable of substantially confining or at least mitigating explosive energy of a detonated explosive device. The assembly 10 comprises a containment (or housing) structure 12 and a door 14 depicted in a partially open position relative to the containment structure 12 and the access opening 18. The containment structure 12 and the door 14 are connected by an elongated hinge joint 16 extending along and operatively connecting a corresponding side of each of the containment structure 12 and door 14. A portion or frame structure 15 of the containment structure 12 defines at least one opening 18 in communication with a chamber 19 defined by the containment structure 12.

Figure 1B:
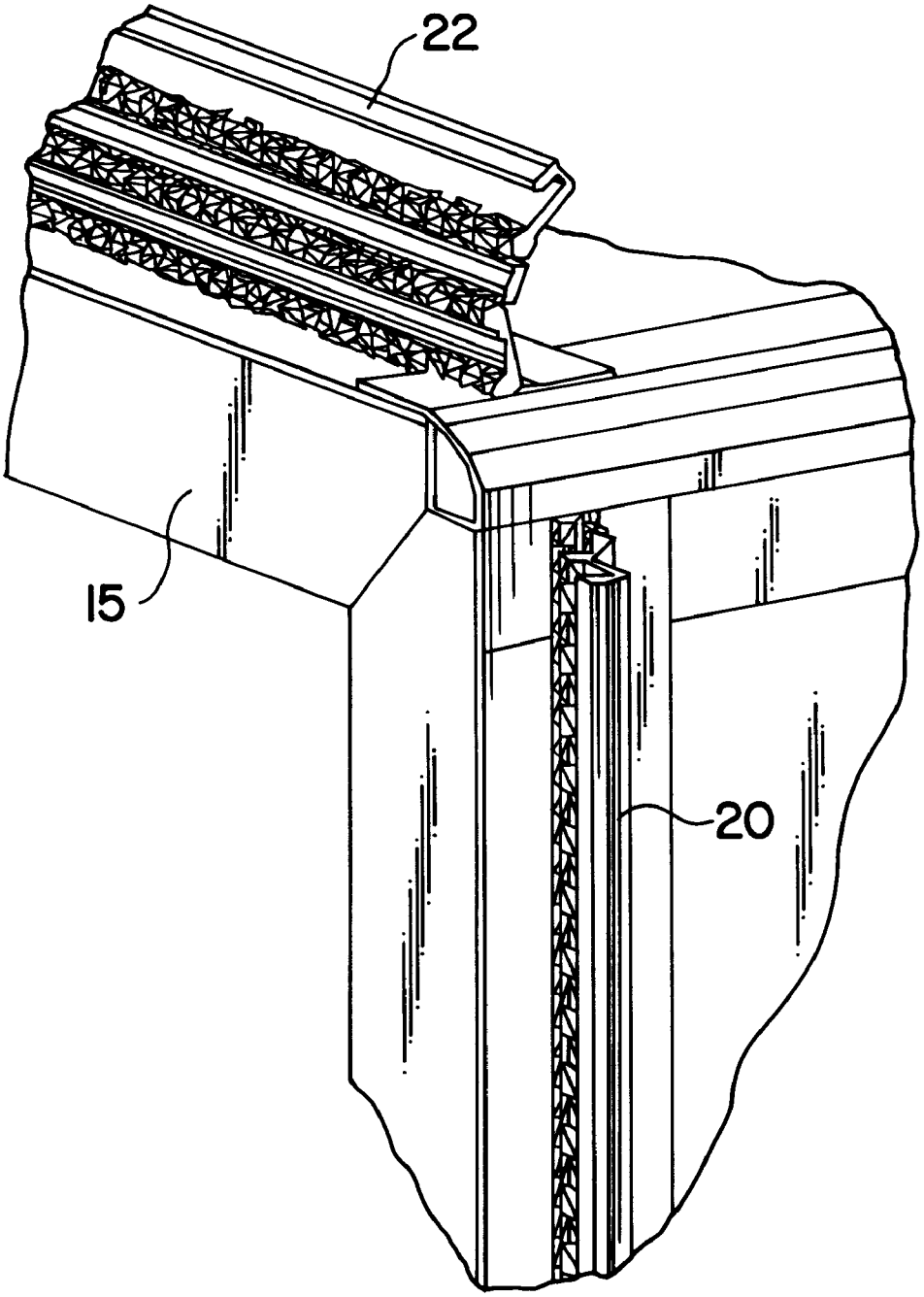
FIG. 1B is an enlarged view of a portion of the enclosure assembly shown in FIG. 1A.

As shown in FIGS. 1A and 1B, the containment structure 12 and door 14 include three sets of mutually-engageable flanges (also referred to herein as engagement members) on the remaining non-hinged sides. More specifically, the containment structure 12 includes a vertically-oriented elongated side engagement flange 20, an elongated top engagement flange 22, and an elongated bottom engagement flange 24. The side, top, and bottom flanges of the containment structure 12 are respectively mutually engageable with an elongated side engagement flange 30, an elongated top engagement flange 32, and an elongated bottom engagement flange 34 of the door 14. The construction and arrangement of each of these sets of corresponding engagement flanges are substantially identical. In the interest of brevity, the engagement flanges are discussed in greater detail with reference to flanges 20 and 30 in FIGS. 2A to 2D.

Figure 2A:
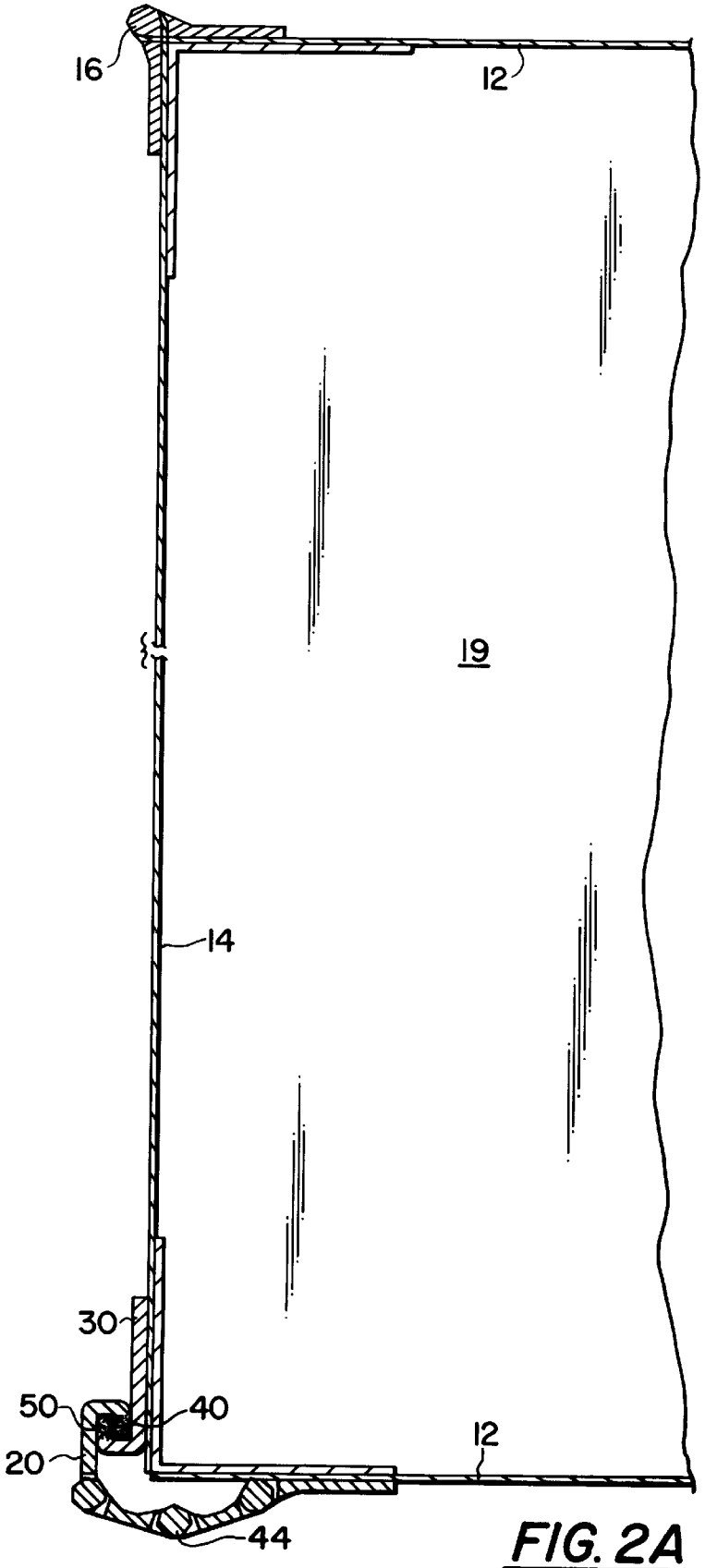
FIGS. 2A to 2D are sectional views of the enclosure assembly shown in FIG. 1A illustrating a sequence of steps performed to disengage and operatively unlock corresponding engagement flanges and move the door from a closed position to an open position in accordance with an embodiment of this invention.
Figure 2B:
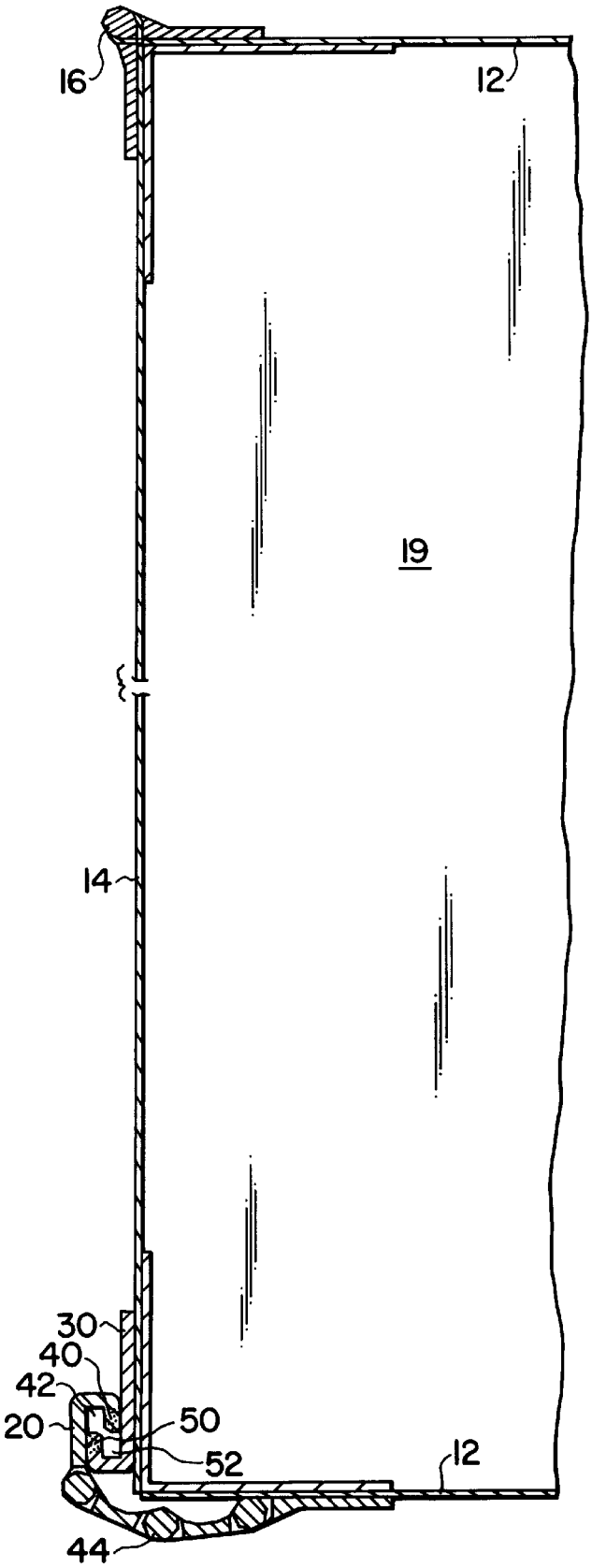
Figure 2C:
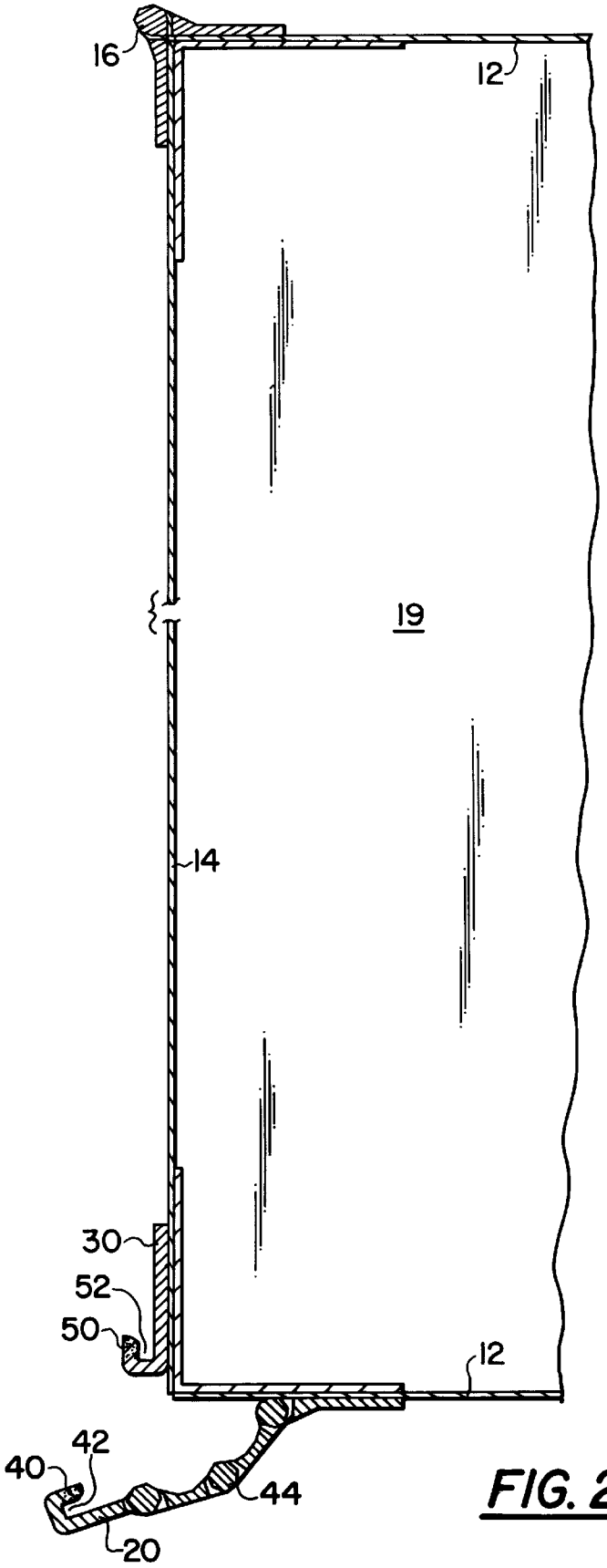
Figure 2D:
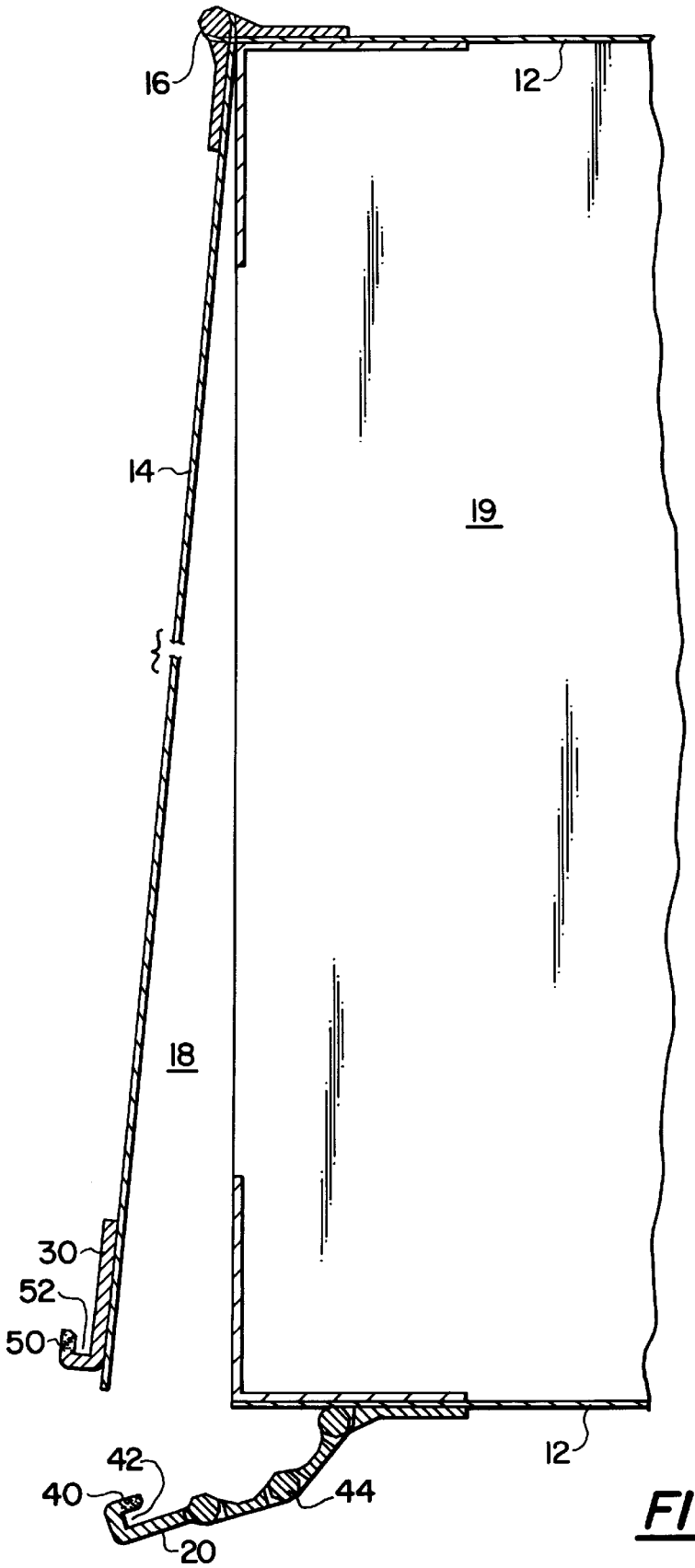

FIG. 2A depicts the engagement flanges 20 and 30 in interlocking and mutually engaged arrangements, with the door 14 in a closed position relative to the containment structure 12 such that the door 14 obstructs and preferably prevents access to the chamber 19 through the access opening 18 (FIG. 2D). As shown in FIG. 2A, the engagement flanges 20 and 30 have latching portions 40 and 50, respectively, which are designated by shaded areas. In the mutually engaged arrangement, the latching portion 40 is received in a latch-receiving groove 52 (FIG. 2B) of the door flange, and the latching portion 50 is received in a latch-receiving groove 42 (FIG. 2B) of the containment-structure flange 20. In the illustrated embodiment, the latch-receiving grooves 42 and 52 both face along a direction parallel with a plane in which the door 14 lies. In the arrangement depicted in FIG. 2A, relative movement of the door 14 away from the containment structure 12 and into its open position is prevented by the mutual cooperation between the latching portions 40 and 50, which abut each other as the door 14 is urged away from the containment structure 12.

Referring to FIG. 2B, the engagement flange 20 includes an articulated portion (or articulated jointed hinged portion) 44, such as a hinge, constructed and arranged to permit the latching portion 40 and the latch-receiving groove 42 to be moved (via sliding along a substantially linear path) away from the latch-receiving groove 52 and the latching portion 50, respectively, to partially or completely slide the latching portions 40 and 50 out from their corresponding latch-receiving grooves 52 and 42 and out of mutual engagement. When moved out of mutual engagement, as shown in FIG. 2B, the articulated portion 44 permits the engagement flange 20 to be pivoted relative to the engagement flange 30 into the non-interlocking arrangement shown in FIG. 2C. In this regard, the sliding motion discussed in connection with FIGS. 2A and 2B should (partially) remove the latching portions 40 and 50 from their corresponding latch-receiving grooves 52 and 42 by a distance sufficient to remove the flanges 20 and 30 from mutual engagement and thereby permit pivoting movement to occur. In the non-interlocking arrangement, the flanges 20 and 30 are sufficiently relatively operatively free from each other to permit movement of the door 14 relative to the containment structure 12 from its closed position to its open position. FIG. 2D shows the door in a partially open position.

Although the invention is not necessarily intended to be limited to any principle or theory, it is believed that the demonstrated superior blast mitigating effect of the inventive assembly is attributable, at least in part, to the following feature shown in the drawings. As understood by those skilled in the art, when an explosive device is detonated within the enclosure assembly 10, forces are applied on the interior walls of the containment structure 12 and the door 14, moving all of the interior walls outward. As further understood in the art, the interior walls of the containment structure 12 and door 14 initially tend to deform, mostly by bending, rotating relative to each other and reconfiguring towards a substantially spherical form. In this deformation regime, the edges or sides of the door 14 tend to rotate relative to the edges or sides of the containment structure 12 with which the door 14 is associated. This action applies a bending moment about an axis parallel to the door/opening edges. At this point, the explosive force tends to produce a rotational torque which tends to rotate the engagement members (since they are attached to the structures 12 and 14) relative to each other. Conventional latches could either be destroyed by such a bending moment or rotated into a disengagement position. To prevent disengagement, the engagement members of this invention are designed so that when in the mutually engaged arrangement shown in FIG. 2A, the deformation caused by the explosion urges the corresponding engagement flanges towards each other and towards mutual engagement. Further, the walls defining the latch-receiving grooves do not provide sufficient clearance for the latching portions received therein to pivot or to undergo such rotation in response to an explosive force. To the contrary, absent deformation of the engagement flanges themselves, the latching portions remain in their corresponding latch-receiving grooves. The mutually aligning characteristic of this design if facilitated by, but not predicated on, the use of hinges to locate one of the engagement flanges and by the use of a door that is flexible in bending relative to the forces obtaining in a blast event. The strength of the design is further enhanced by its inherent applicability to continuous latches spanning the entire (or substantially the entire) non-hinged portion of the perimeter of the door/containment structure interface. This allows the forces obtaining at the interface to be distributed along a much greater portion of the interface, enabling the use of a lighter sealing mechanism and less stiff, and therefore lighter, door and door frame.

A second embodiment of this invention is illustrated in FIGS. 3A–3D. To facilitate an understanding of the structure and operation of this embodiment, it should be understood that the components of the embodiment depicted in FIGS. 3A–3D corresponding in structure and/or function to the components of the embodiment of FIGS. 1A and 2A–2D have been designated with the same reference numerals to those used to designate the corresponding components of FIGS. 1A, 1B, and 2A–2D (where appropriate), with the addition of the prefix 1. For example, the corresponding structure of the assembly 10 shown in FIGS. 1A, 1B, and 2A–2D is designated by reference numeral 110 in FIG. 3.

Figure 3A:
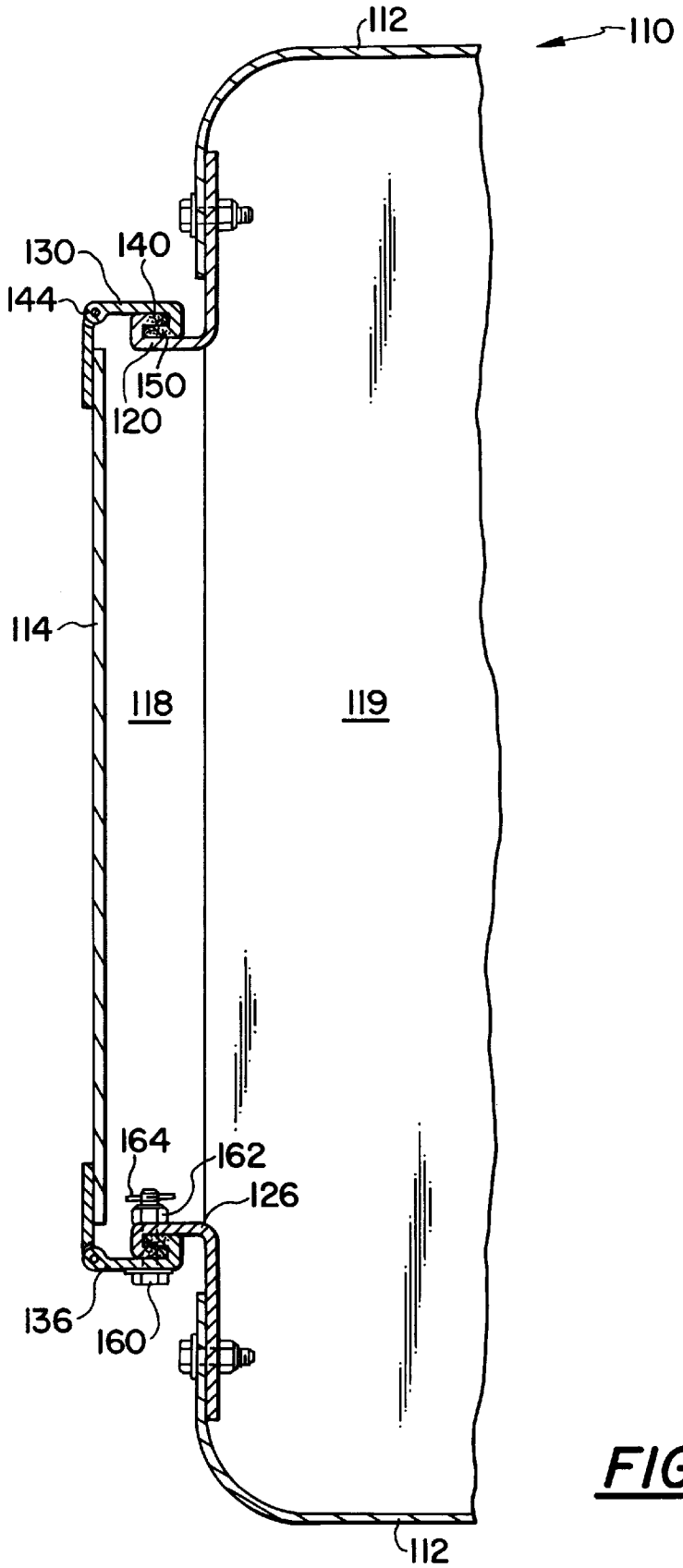
FIGS. 3A to 3D are sectional views illustrating a sequence of steps performed to disengage and operatively unlock corresponding engagement flanges and move the door from a close position to an open position in accordance with another embodiment of this invention.
Figure 3B:
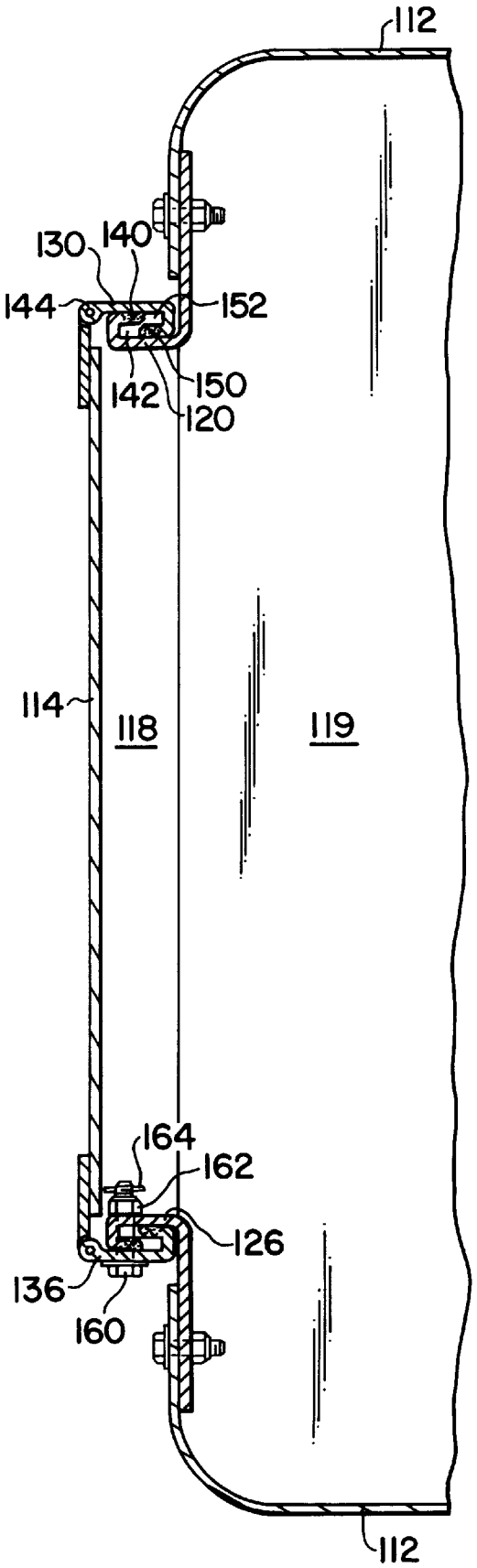
Figure 3C:
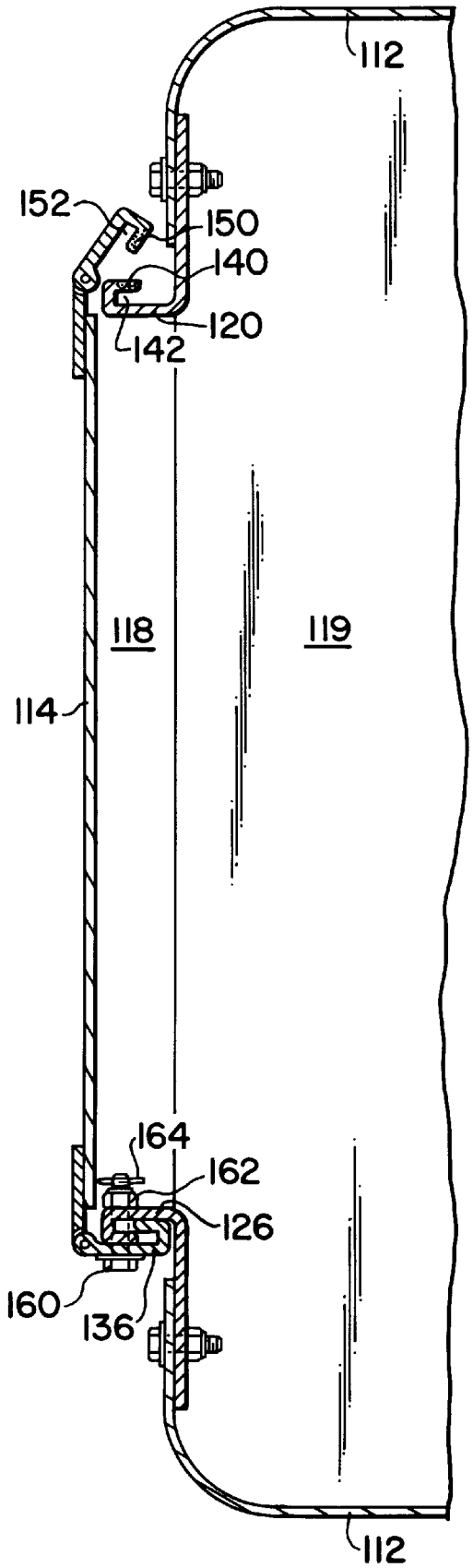
Figure 3D:
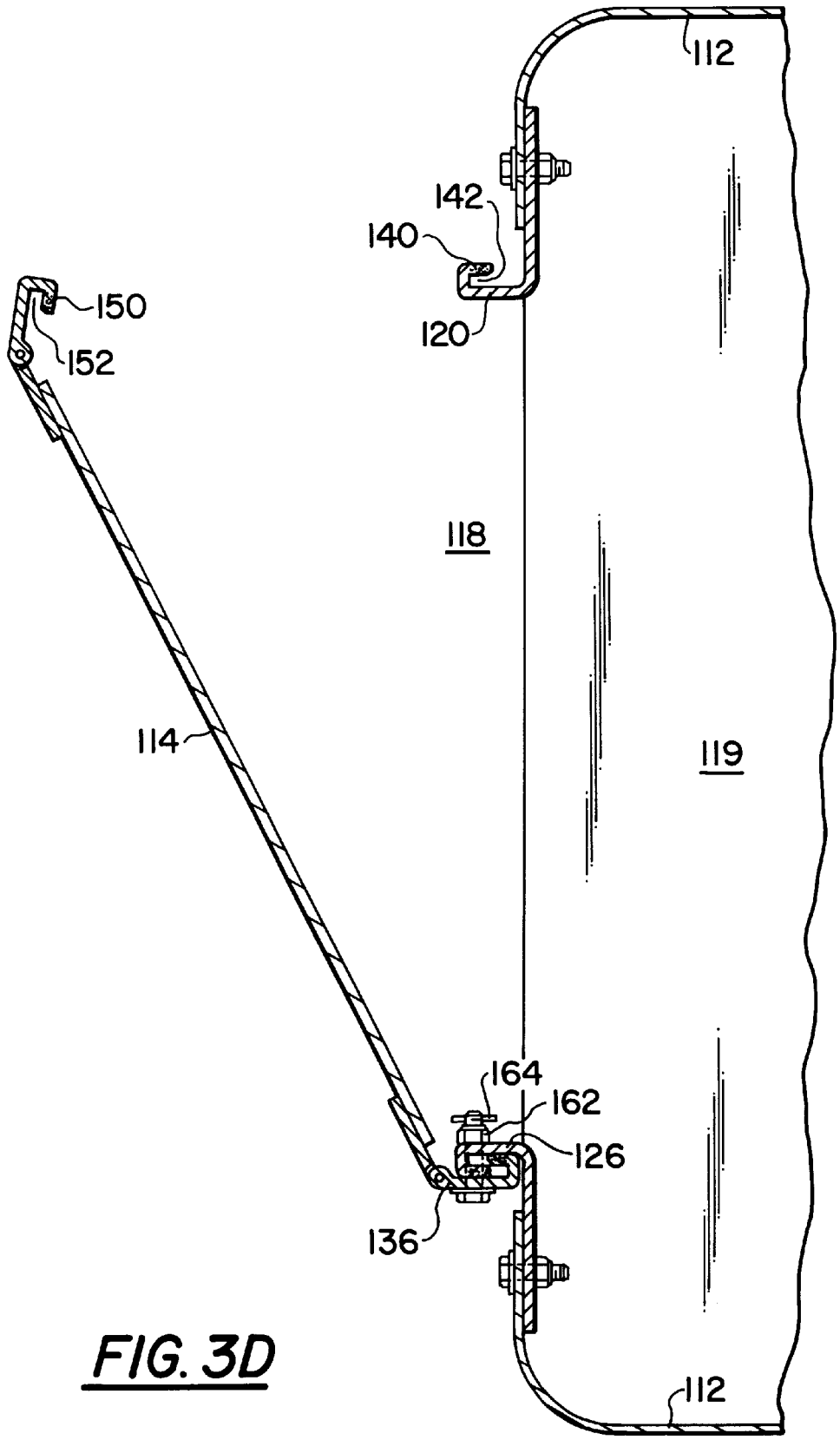

In the second embodiment, when the elongated flanges (or engagement members) 120 and 130 are in the mutually engaged arrangement shown in FIG. 3A, the latch-receiving grooves 142 and 152 (FIGS. 3B–3D) both face along a direction perpendicular to a plane in which the door structure 114 lies. However, as with the first embodiment and as shown in FIG. 3A, when the flanges 120 and 130 are mutually engaged the latch-receiving grooves 142 and 152 do not provide sufficient clearance for the latching portions 140 and 150 received therein to pivot or to undergo rotation in response to an explosive force. A comparison of FIGS. 3A and 3B shows that the latching portions 140 and 150 are removed from their corresponding latch-receiving grooves 152 and 142 by sliding the door 114 towards the containment structure 112. As shown in FIG. 3C, once the latching portions 140 and 150 have been at least partially removed from their corresponding latch-receiving grooves 152 and 142, the engagement flange 130 may be pivoted about hinge portion 144 to thereby move the engagement flanges 120 and 130 into a non-interlocking arrangement. In this regard, the sliding motion discussed in connection with FIG. 3B should (partially) remove the latching portions 140 and 150 from their corresponding latch-receiving grooves 152 and 142 by a distance sufficient to permit this pivotal movement. In the non-interlocking arrangement, the flanges 120 and 130 are sufficiently relatively operatively free from each other to permit relative movement between the door 114 and the containment structure 112 from a closed position in which the door 114 obstructs the access opening to inhibit the chamber 119 from being accessed through the access opening 118 to an open position, shown in FIG. 3D, in which the chamber 119 is accessible through the access opening 118.

Unlike the first embodiment, in the second embodiment illustrated in FIGS. 3A to 3D the elongated hinge joint 16 depicted in FIGS. 1A and 2A–2D is replaced by a set of mutually engageable flanges 126 and 136 connected to each other via a series of standard drilled bolts 160 and standard castle nuts 162, which can be captivated together via cotter pins 164 to guide the sliding motion between the flanges 126 and 136. The bolts 160 prevent the set of mutually engageable flanges 126 and 236 from sliding relative to one another so that the articulated connection between the engageable flange 136 and the door 114 provides a pivot line about which the door 114 pivots as the door 114 is moved between its closed and open positions. The second embodiment also differs from the first embodiment inasmuch as the flanges 120 and 130 are slid into and out of mutual engagement by moving the door 114 relative to the containment structure 112; the hinge portion 144 does not permit movement of the door flange 120 independent of the movement of the door 114. Similar to the previous embodiment, the mutually aligning characteristic of this design is facilitated by, but not predicated on, the use of hinges to locate the door engagement flange 130 and by the use of a door frame arrangement that is flexible in bending relative to the forces obtained in a blast event. The strength of the design is further enhanced by its inherent applicability to continuous latches spanning the entire periphery of the door/containment structure interface.

Figure 4:
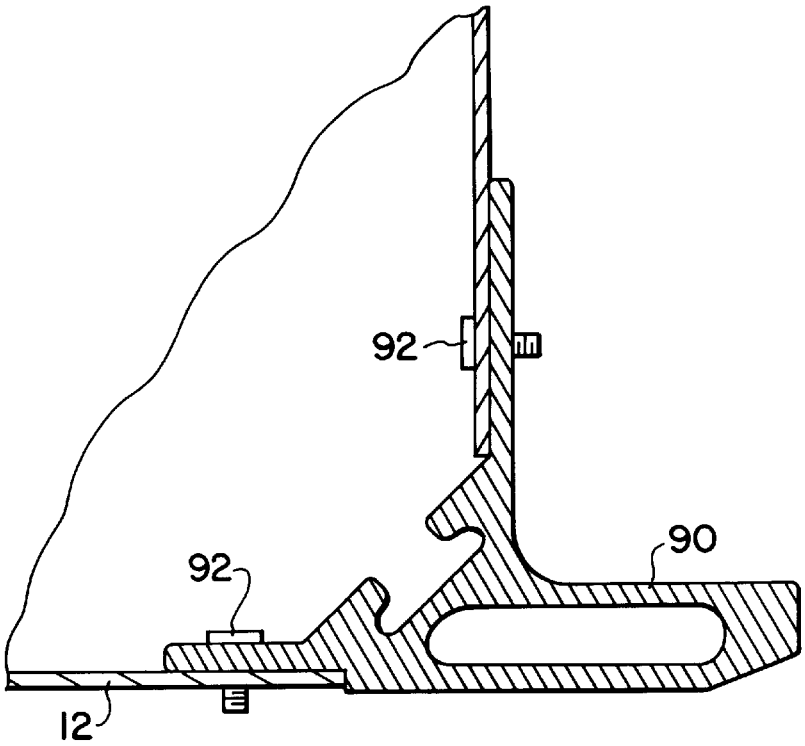
FIG. 4 is a sectional view of the enclosure assembly showing a tie-down technique for securing the containment structure to a vehicle.
Figure 5:
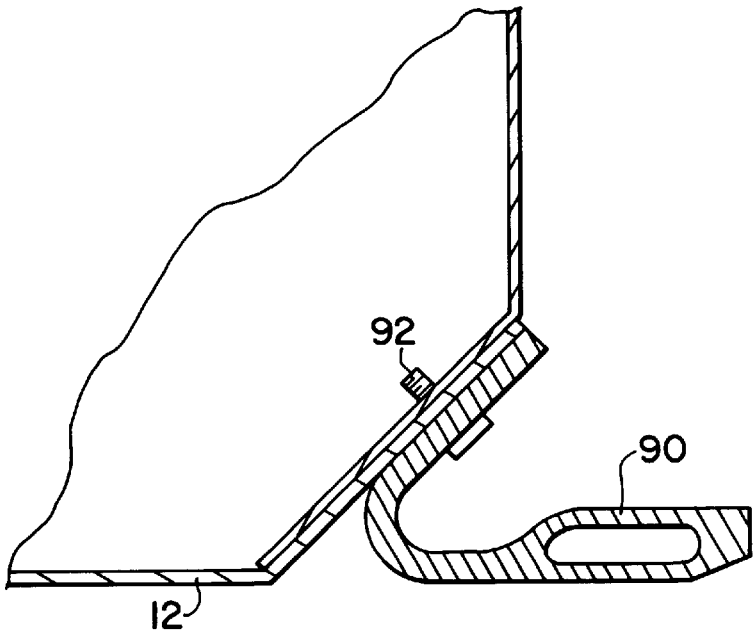
FIG. 5 is a sectional view of the enclosure assembly showing another tie-down technique for securing the containment structure to a vehicle.

FIGS. 4 and 5 respectively illustrate two techniques for securing the assembly 10 to a base assembly (e.g., a vehicle, such as an aircraft). In FIG. 4, a set of extruded frame members 90 is used as a structural part of the base assembly. The base and walls of the assembly 10 are bolted with bolts 92 to these extrusions 90. These extrusions are provided with a lip for the tie down of the assembly 10.

In FIG. 5, the containment structure 12 was reconfigured to include a sloping wall bolted with bolts 92 to the base and side walls. The extrusion 90 provides the lip for typing down the containment structure. This extrusion is bolted to the outside of the sloping wall.

Although not shown in the drawings, various constructions and arrangements of the elongated engaging members can exist at the comers of the assembly 10. For example, for a blast-resistant container assembly, gaps suitable for venting gases can be included at one or more of the corners. In other applications, the comers can be reinforced and/or sealed. Such reinforcement may serve to secure ends of the engagement members to their corresponding containment or door structure or, in the case where an engagement member terminates at an end in proximity to an end of another engagement member, to secure the two engagement members together. The reinforcement can be configured as an L-bracket connected to both the engagement member and the containment structure or door structure, a standard gusset connecting two adjacent engagement members, or other known reinforcement structures.

Various materials can be used to make the assembly 10 (and 110). For example, the door 14 (and 114) can be made of GLARE, which is supplied by Structural Laminated Corporation of New Kensington, Pa. The hinge joint 44 (and 144) can be made of aluminum, such as a MS (Military Specification) 20001 hinge. The elongated engagement members can be made of, for example, extruded aluminum, such as Aluminum 6061-T6. Finally, the containment structure 12 (and 112) and other additional components of the assembly can be made from sheet aluminum, such as Aluminum 6061-T6, GLARE, or other suitable and reinforced material.

The design of the assembly, and in particular the elongated engagement members, lends itself to the distribution of an internal traumatic or continual load over a large area. Consequently, one advantage of the assembly of this invention is the relatively light weight that it possesses. Another advantage that derives from this assembly is the relatively low production costs associated with its production.

In its broadest aspects, several variations and modifications to the above-discussed assembly can be implemented without departing from the scope of this invention. For example, in the various figures, each of the engagement members is connected to its corresponding containment or door structure with standard bolts and nuts. A series of nut and bolt sets can be arranged in spaced relation along the length of this connection. It is understood, however, that such connections can be accomplished with other suitable conventional fastener or combination of fasteners, including rivets and/or epoxy chemicals. Alternatively, the connections between the engagement flanges and the door or the engagement flanges and containment structure can be accomplished by integrally forming these parts.

Further, the complementary flange sets may be arranged above, below, or on one or both sides of the access opening, or any combination thereof. Moreover, where the containment structure (or access opening) has a polygonal cross-section other than the rectangular shape depicted in the drawings (e.g., a pentagonal or octagonal cross-section), additional sets of complementary flanges can be employed, and the flanges do not have to be arranged at opposing sides of the access opening. In this regard, it is noted that an odd number of sets of complementary flanges can be employed, if desired.

According to another variant embodiment of the present invention, the 3-wall hook-shaped configuration of the complementary engagement members can be modified to have, for example, two walls that collectively define a V-shaped channel. In this regard, it is noted that the door-structure engagement members are not required to possess identical shapes to their corresponding containment-structure engagement members. The sets of flanges should, however, be mutually engageable with each other.

According to still another variant embodiment of the present invention, the captivated bolt and castle nut can be replaced by a comparable fastener, with a standard continuous hinge or a comparable fastener, or can be removed in its entirety so that the door structure is completely detachable from the containment structure.

Fasteners such as quick-release pins may be employed to retain the door structure in its closed position and the interlocking flanges in their mutually engaged position. Such quick-release pins may extend through the mutually engaged door and containment-structure flanges. Also, lift-and-turn latches may be employed to guide the movement of the corresponding flanges between interlocking and non-interlocking arrangements. Suitable quick-release pins and lift-and-turn latches are available from McMaster-Carr.

Each of the door flanges can be formed continuously or non-continuously along a portion or the entire length of one of the sides of the door structure. Similarly, each of the containment-structure flanges can be formed continuously or non-continuously along a portion or the entire length of the portion of the containment structure and/or access opening. Moreover, more than one elongated engagement member of the door structure may be formed along one of the sides of the door structure, and/or more than one elongated engagement member of the containment structure may be formed along a portion of the containment structure defining one of the sides of the access opening.

The assembly can also include a plurality of doors with a plurality of access openings in communication with the chamber, and/or can include a plurality of chambers.

The foregoing detailed description of selected embodiments of the invention has been provided for the purposes of illustration and description. It is not intended to be exhaustive or to limit the invention to the precise embodiments disclosed. Obviously, many modifications and variations will be apparent to practitioners skilled in the art. The embodiments were chosen and described in order to best explain the principles of the invention and its practical application, thereby enabling others skilled in the art to understand the invention for various embodiments and with various modifications as are suited to the particular use contemplated. It is intended that the scope of the invention be defined by the following claims and their equivalents.

What I claim is:

1. An explosion-mitigating assembly comprising:

a containment structure defining at least one chamber and having at least one access opening sized to permit a plurality of articles to be inserted into and removed from said chamber, said containment structure comprising at least one hook-shaped flange defining at least one latch-receiving groove and a latch portion; and at least one door which in a closed position is sized and configured to prevent access to said chamber through said access opening, said door comprising at least one hook-shaped door flange defining at least one latch-receiving door groove and a door latch portion, wherein at least one of said flange of said containment structure and said door flange is pivotally connected to said containment structure and said door, respectively, wherein in the closed position, said door flange is slidable along a non-pivotal path relative to said flange of said containment structure from out of mutual engagement to a position of mutual engagement in which said latch portion of said containment structure is received in said latch-receiving door groove and said door latch portion is received in said latch-receiving groove of said containment structure, said flange of said containment structure and said door flange not being pivotal out of mutual engagement, and wherein said flange of said containment structure and said door flange positioned out of mutual alignment are pivotal relative to each other into a non-interlocking arrangement in which said flanges are sufficiently operatively free from each other to not prevent movement of said door relative to said containment structure between the closed position to an open position in which said chamber is accessible through said access opening.

2. An assembly according to claim 1, wherein said flange of said containment structure is non-integrally attached to said containment structure, and further wherein said door flange is non-integrally attached to said door.

3. An assembly according to claim 1, further comprising an articulated member associated with either said flange of said containment structure to pivotally connect said flange of said containment structure to said containment structure, or said door flange to pivotally connect said door flange to said door, wherein said articulated member has sufficient degrees of movement to slide said associated flange relative to the other flange along a non-pivotal path into and out of mutual engagement and to pivot said associated flange relative to the other flange into and out of non-interlocking arrangement.

4. An assembly according to claim 1, wherein said flange of said containment structure and said door flange are elongated.

5. An assembly according to claim 1, wherein said containment structure is hinged to said door in proximity to a side of said access opening, and further wherein said flange of said containment structure and said door flange are arranged in proximity to said access opening along another side of said access opening which is different from said side at which said containment structure is hinged to said door.

6. An assembly according to claim 1, wherein said flange of said containment structure and said door flange are in proximity to a first side of said access opening and constitute a first set of flanges, and further wherein said containment structure has at least two additional flanges and said door has at least two additional door flanges, said additional flanges of said containment structure being paired with respective ones of said additional door flanges to constitute at least second and third sets of said flanges, said second and third sets of said flanges being respectively disposed in proximity to second and third sides of said access opening, so that at least three sides of said access opening have a respective one of said sets of said flanges.

7. An assembly according to claim 1, wherein said chamber of said assembly is sized and configured to receive a plurality of pieces of luggage.

8. An assembly according to claim 7, wherein said assembly is sized and configured to be stowed in an aircraft.

9. An assembly according to claim 1, wherein in mutual engagement, said latch portion of said flange of said containment structure and said latch portion of said door flange extend along opposite directions parallel to a plane in which said door is positioned.

10. An assembly according to claim 1, wherein in mutual engagement, said latch portion of said flange of said containment structure and said latch portion of said door flange extend sufficiently far into and are received by a sufficiently small clearance of said latch-receiving groove of said door flange and said latch-receiving groove of said flange of said containment structure, respectively, to prevent relative pivotal movement between said flange of said containment structure and said door flange out of mutual engagement.

11. An explosion-mitigating assembly comprising:

a containment structure defining at least one chamber and having at least one access opening sized to permit a plurality of articles to be inserted into and removed from said chamber, said containment structure comprising at least one flange in proximity a first side of said access opening;

at least one door which in a closed position is sized and configured to prevent access to said chamber through said access opening, said door comprising at least one door flange in proximity the first side of said access opening, said door in the closed position having said door flange mutually engageable with said flange of said containment structure; and a hinge joint disposed in proximity to a side of said access opening and connecting said containment structure and said door, said side of said access opening in proximity to said hinge joint being different than said first side of said access opening, wherein at least one of said flange of said containment structure and said door flange is pivotally connected to said containment structure and said door, respectively, wherein in the closed position, said door flange is slidable along a non-pivotal path relative to said flange of said containment structure from out of mutual engagement to a position of mutual engagement in which said flange of said containment structure and said door flange are not pivotal out of mutual engagement by a sufficient distance to allow said door to be moved from the closed position to an open position in which said chamber is accessible through said access opening, and wherein said flange of said containment structure and said door flange positioned out of mutual alignment are pivotal relative to each other into a non-interlocking arrangement in which said flanges are sufficiently operatively free from each other to not prevent movement of said door relative to said containment structure between the closed and open positions.

12. An assembly according to claim 11, wherein said flange of said containment structure is non-integrally attached to said containment structure, and further wherein said door flange is non-integrally attached to said door.

13. An assembly according to claim 12, further comprising an articulated member associated with either said flange of said containment structure to pivotally connect said flange of said containment structure to said containment structure, or said door flange to pivotally connect said door flange to said door, wherein said articulated member has sufficient degrees of movement to slide said associated flange relative to the other flange along a non-pivotal path into and out of mutual engagement and to pivot said associated flange relative to the other flange into and out of non-interlocking arrangement.

14. An assembly according to claim 11, wherein said flanges of said containment structure and said door are elongated.

15. An assembly according to claim 11, wherein said flange of said containment structure and said door flange constitute a first set of flanges, and further wherein said containment structure has at least two additional flanges and said door has at least two additional door flanges, said additional flanges of said containment structure being paired with respective ones of said additional door flanges to constitute at least second and third sets of said flanges, said second and third sets of said flanges being respectively disposed in proximity to second and third sides of said access opening which are different than said side in proximity to said hinge joint, so that at least three sides of said access opening have a respective one of said sets of said flanges.

16. An assembly according to claim 11, wherein in mutual engagement, said latch portion of said flange of said containment structure and said latch portion of said door flange extend sufficiently far into and are received by a sufficiently small clearance of said latch-receiving groove of said door flange and said latch-receiving groove of said flange of said containment structure, respectively, to prevent relative pivotal movement between said flange of said containment structure and said door flange out of mutual engagement.

17. An explosion-mitigating assembly comprising:

a containment structure defining at least one chamber and having at least one access opening sized to permit a plurality of articles to be inserted into and removed from said chamber, said containment structure comprising at least first and second flanges; and at least one door which in a closed position is sized and configured to prevent access to said chamber through said access opening, said door comprising at least first and second door flanges, said door in the closed position having said first and second door flanges mutually engageable with said first and second door flanges of said containment structure, wherein said first flange of said containment structure and said first door flange are in proximity to a first side of said access opening and constitute a first set of flanges, and further wherein said second flange of said containment structure and said second door flange are in proximity to a second side of said access opening and constitute a second set of flanges, said first side of said access opening being different than said second side, wherein at least one of said flanges of said containment structure and said door flanges is pivotally connected to said containment structure and said door, respectively, wherein in the closed position, said door flanges are slidable along a non-pivotal path relative to said flanges of said containment structure to positions of mutual engagement in which said flanges of said containment structure and said door flanges are not pivotal out of mutual engagement by a sufficient distance to allow said door to be moved from the closed position to an open position in which said chamber is accessible through said access opening, and wherein said flanges of said containment structure and said door flanges positioned out of mutual alignment are pivotal relative to each other into a non-interlocking arrangement in which said flanges are sufficiently operatively free from each other to not prevent movement of said door relative to said containment structure between the closed and open positions.

18. An assembly according to claim 17, wherein said flanges of said containment structure are non-integrally attached to said containment structure, and further wherein said door flanges are non-integrally attached to said door.

19. An assembly according to claim 18, wherein said flanges of said containment structure and said door are elongated.

20. An assembly according to claim 17, wherein in mutual engagement, said latch portion of said flange of said containment structure and said latch portion of said door flange extend sufficiently far into and are received by a sufficiently small clearance of said latch-receiving groove of said door flange and said latch-receiving groove of said flange of said containment structure, respectively, to prevent relative pivotal movement between said flange of said containment structure and said door flange out of mutual engagement.

21. An aircraft, wherein the improvement is that said aircraft carries the assembly of claim 1.

22. An aircraft, wherein the improvement is that the aircraft carries the assembly of claim 11.

23. An aircraft, wherein the improvement is that the aircraft carries the assembly of claim 17.

* * * * *